US008100744B2

(12) United States Patent
Lamers

(10) Patent No.: US 8,100,744 B2
(45) Date of Patent: Jan. 24, 2012

(54) CORNER SANDER

(76) Inventor: John Lamers, Ingersoll (CA)

( * ) Notice: Subject to any disclaimer, the term of this patent is extended or adjusted under 35 U.S.C. 154(b) by 538 days.

(21) Appl. No.: 12/406,185

(22) Filed: Mar. 18, 2009

(65) Prior Publication Data

US 2009/0247058 A1 Oct. 1, 2009

Related U.S. Application Data

(60) Provisional application No. 61/041,263, filed on Apr. 1, 2008.

(51) Int. Cl.
*B24B 23/00* (2006.01)

(52) U.S. Cl. ..... 451/354; 451/512; 451/523; 451/524

(58) Field of Classification Search ..... 451/354, 451/512, 523, 524, 495, 514; 15/235.7
See application file for complete search history.

(56) References Cited

U.S. PATENT DOCUMENTS

| | | | | | |
|---|---|---|---|---|---|
| 2,817,931 | A | * | 12/1957 | Houser | 451/522 |
| 4,757,572 | A | * | 7/1988 | Yon | 15/235.7 |
| 4,825,597 | A | * | 5/1989 | Matechuk | 451/524 |
| 5,313,746 | A | * | 5/1994 | Zarriello | 451/522 |
| 5,544,384 | A | * | 8/1996 | Forselius et al. | 15/235.7 |
| 5,605,500 | A | * | 2/1997 | Matechuk | 451/456 |
| 5,899,210 | A | * | 5/1999 | Letherby et al. | 132/76.4 |
| D416,648 | S | * | 11/1999 | Letherby et al. | D28/59 |
| 6,325,708 | B1 | * | 12/2001 | Miles | 451/354 |
| 6,439,988 | B1 | * | 8/2002 | Long et al. | 451/495 |
| D497,092 | S | * | 10/2004 | McCarthy | D8/90 |
| 6,905,290 | B1 | * | 6/2005 | Casciato, Jr. | 407/29.15 |
| 7,011,570 | B1 | * | 3/2006 | Mac Leod | 451/356 |
| 7,156,728 | B1 | * | 1/2007 | Killough | 451/361 |
| 7,264,541 | B1 | * | 9/2007 | Ray et al. | 451/344 |
| 7,485,031 | B1 | * | 2/2009 | Stubbs | 451/523 |
| 2003/0224708 | A1 | * | 12/2003 | Koenig, Jr. | 451/461 |
| 2004/0043715 | A1 | * | 3/2004 | Miles | 451/526 |
| 2006/0135049 | A1 | * | 6/2006 | Petersen et al. | 451/495 |
| 2009/0047882 | A1 | * | 2/2009 | Collins | 451/524 |
| 2009/0247058 | A1 | * | 10/2009 | Lamers | 451/354 |

* cited by examiner

*Primary Examiner* — George Nguyen

(57) ABSTRACT

A corner sander base including a sanding surface, the corner sander base for sanding proximate interior wallboard corners, the corner sander base including a first member and a second member connected together at a longitudinally oriented juncture where they form a tip, one side of the members defining a sanding surface. Each member further includes a planar forward section which in the radial direction originates at the juncture and terminates at a longitudinally oriented transition wherein a forward angle is the angle subtended between the planar forward sections in the radial plane. Each member further includes a planar rear section originating at the transition and connected to the forward section at the transition wherein a rear angle is the angle subtended between the planar rear sections in the radial plane and wherein the forward and rear angles selected to more aggressively sand the areas at the rear sections and less aggressively sand the area at the tip and forward section.

20 Claims, 9 Drawing Sheets

(PRIOR ART)

(PRIOR ART)

(PRIOR ART)

CORNER SANDER

This application claims priority from previously filed U.S. provisional application 61/041,263 filed Apr. 1, 2008 under the title "Corner Sander" by John Lamers.

FIELD OF THE INVENTION

The present invention relates to sanding devices and in particular relates to corner sanding devices used for sanding of internal corners wherein the walls are covered with wallboard and/or drywall.

BACKGROUND OF THE INVENTION

Presently walls in residential and commercial structures are finished using wall board which is generally screwed or nailed to vertical wooden and/or metal studs, the gaps between the individual boards are covered with a joint reinforcement which is either a paper and/or a mesh and thereafter a drywall compound is applied thereon. In this patent application the words wallboard and/or drywall are used interchangeably to mean the same thing, namely gypsum board which is covered with paper and used for creation of walls prior to drywall compound being applied.

Of particular importance is the finishing of internal corners which are created at the juncture of two wallboards coming together at a corner location.

Presently a gap usually exists between the two wall boards which abut each other at the corner. In order to bridge this gap to prevent future cracking of the drywall compound a layer of paper and/or mesh is applied into the corner and thereafter the drywall compound is liberally applied for subsequent sanding.

The present device relates to the tool and mechanism used for sanding of the drywall compound after the joint paper and the drywall compound has been applied and dried.

There are a number of prior art devices and in particular U.S. Pat. No. 6,325,708 by Jody W. Miles filed on Sep. 28, 2000 and issued on Dec. 4, 2001 titled Device for Sanding a Drywall Corner describes and teaches a corner sander including a base made up of left and right planar wall members which meet at a juncture and/or as in our case at the tip and form a generally v-shape support for the abrasive media to be placed there upon. The V-shaped support is so designed that the sanding pad more aggressively sands the areas in and around the juncture (the tip) of the base and less aggressively sands the areas of the corner away or outwardly from the juncture or the tip. They further explain in the specification and also in the claims that in order to achieve this function the opposed first left and right members which are called "walls" preferably assume angles of slightly less than 90 degrees.

There device and geometry is best shown in FIG. 4 of the U.S. Pat. No. 6,325,708 specification and is schematically reproduced in our FIG. 2 in which it is apparent that the corner of the sanding base aggressively impinges into the wallboard corner and the left wall and right wall of the base creates a large gap on one side of the corner and a smaller gap on the other side of the corner due to the angular relationship between the left wall and right wall being less than 90 degrees.

Referring to FIG. 3 the resulting sanding profile after the tool has been used to smoothly sand away the drywall compound may result in either paper thinning as depicted in FIG. 3 on one side and/or ridges and/or valleys occurring on the other side.

Those trained to finish wall board, wall surfaces and corners will know that it is undesirable to impinge upon the paper since this produces a rough surface finish which is not aesthetically pleasing to the end user.

In addition, it is desirable to have a smooth corner transition and surface free of ridges and valleys and free of paper thinning as depicted in FIG. 3.

BRIEF DESCRIPTION OF THE DRAWINGS

The invention will now be described by way of example only with reference to the following drawings in which.

DETAILED DESCRIPTION OF THE PREFERRED EMBODIMENT

Figure 1:
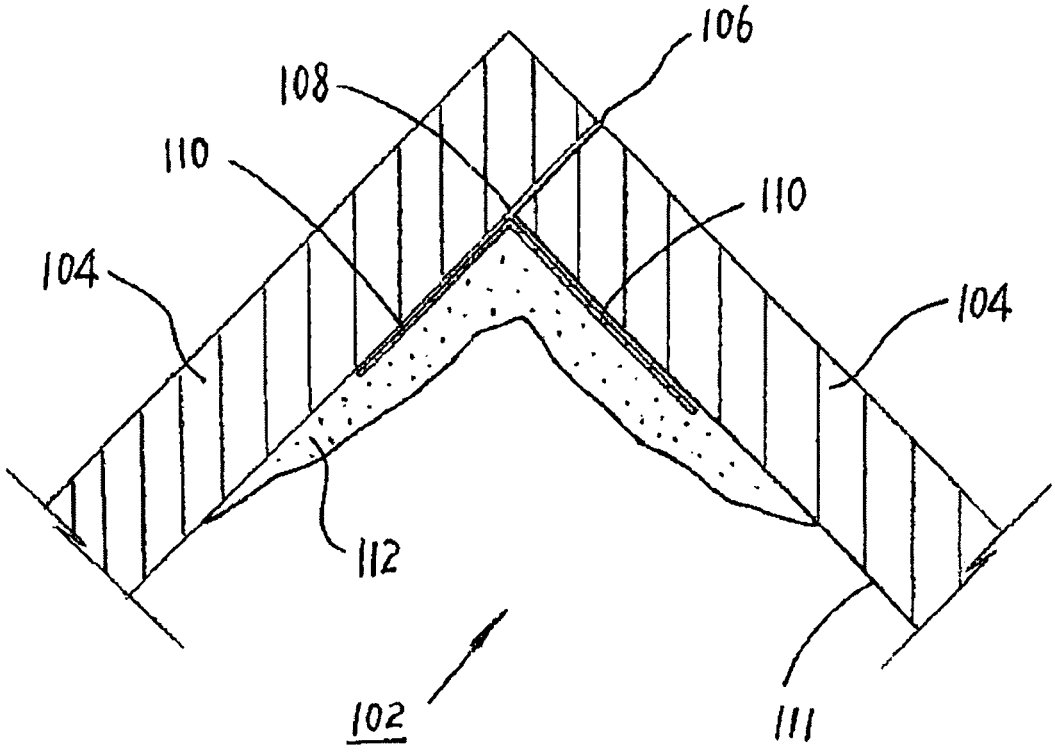
FIG. 1 is a schematic cross sectional view of an inside wall board corner showing paper as well as drywall compound having been applied.
Figure 2:
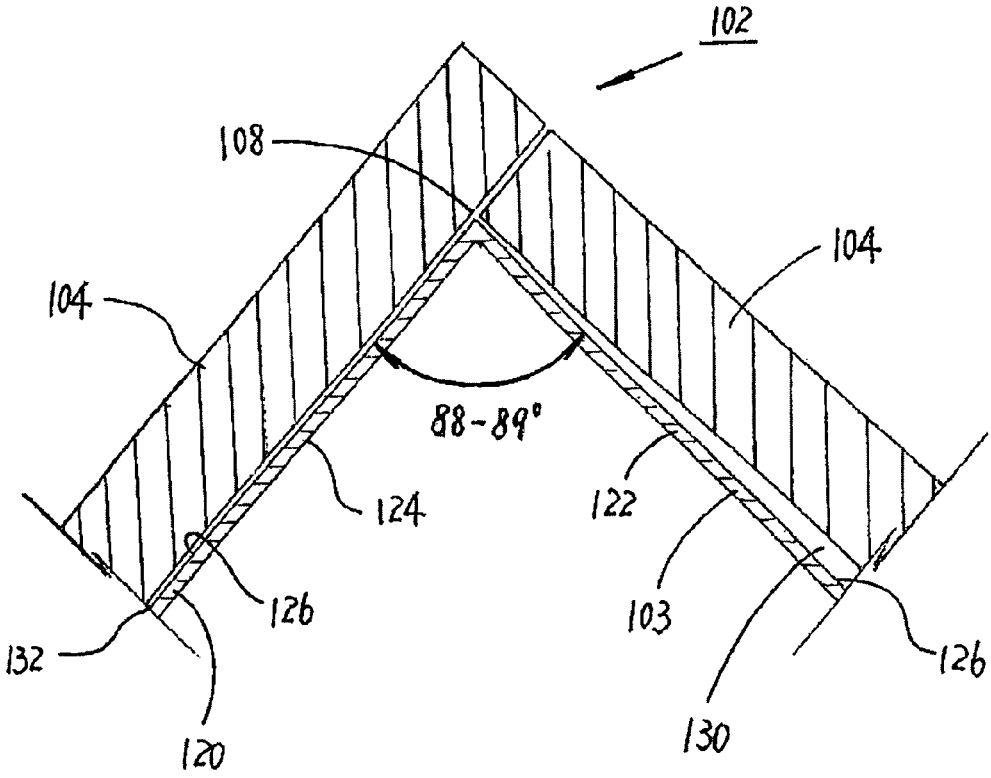
FIG. 2 is a schematic cross sectional view showing the sanding tool described in the prior art deployed in an inside wall board corner of a wall.
Figure 3:
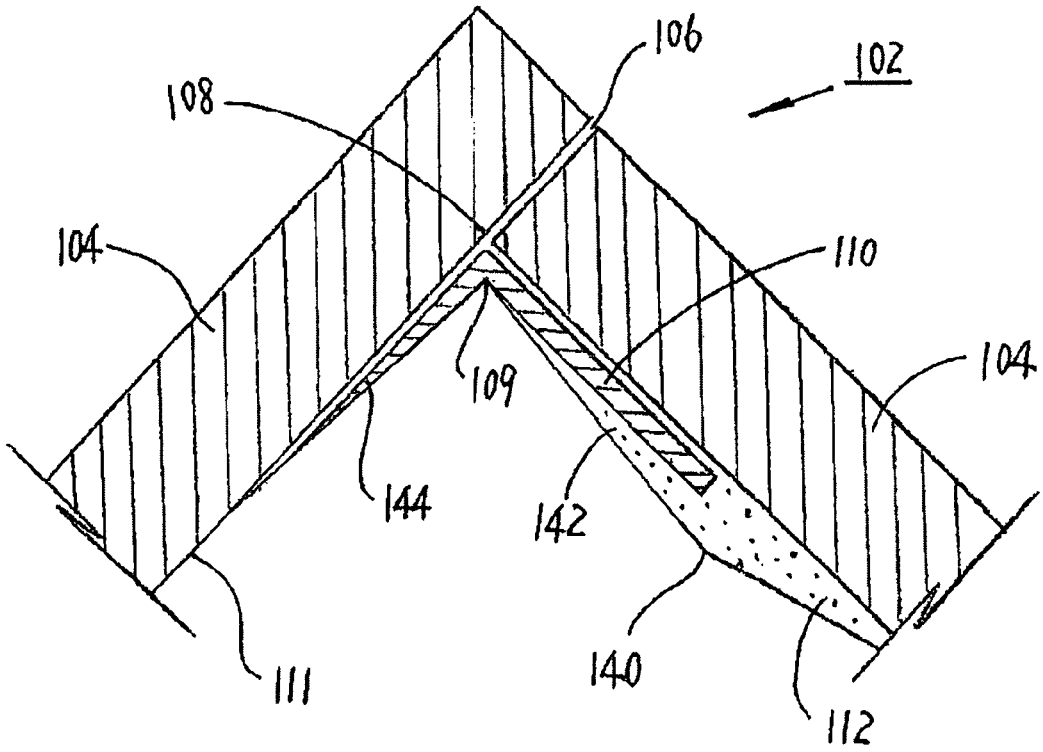
FIG. 3 is a cross sectional schematic view of an inside wall board corner showing the finished surface after sanding has occurred with the prior art unit shown in FIG. 2.

FIGS. 1, 2 and 3 are Figures explaining the prior art and in particular explain and show the potential results of using the prior art unit described in U.S. Pat. No. 6,325,708 by Jody W. Miles patented on Dec. 4, 2001 under the title DEVICE FOR SANDING A DRYWALL CORNER.

FIG. 1 shows schematically an inside wall board corner 102 which includes two wallboards 104 which abut each other at joint gap 106 to form wallboard corner 108. Normally a paper and/or mesh screening and/or some reinforcements means is placed in corner 108 such as paper 110 as shown in FIG. 1 in order to reinforce joint gap 106. Paper 110 as well as the entire joint is then covered with drywall compound 112 as shown schematically in FIG. 1. Once drywall compound 112 is dried, it is then ready for sanding into a smooth corner joint.

Figure 4:
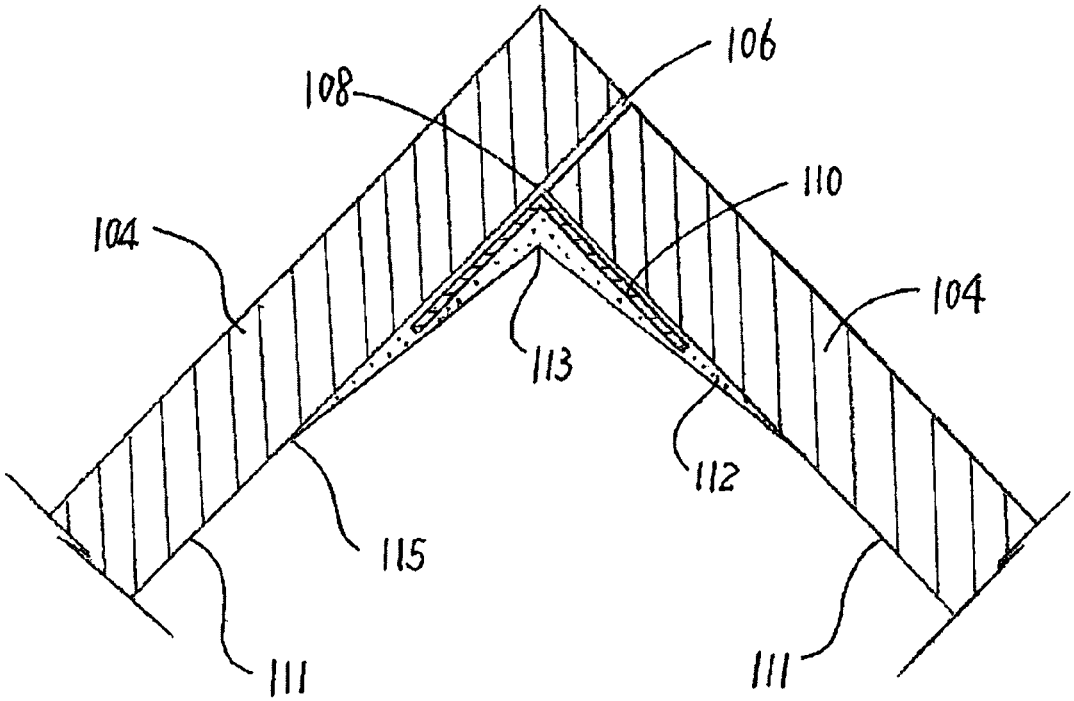
FIG. 4 is a schematic cross sectional view of an inside wall board corner showing the finished outer wall surface together with the remaining paper and drywall compound in the corner after sanding has occurred with the presently described device.

FIG. 2 shows schematically the Miles device U.S. Pat. No. 6,325,708 namely sanding tool 103 deployed into a inside wallboard corner 102 wherein a left wall 120 and a right wall 122 of sanding tool 103 subtends an angle of less than 90 degrees in accordance with the prior art discussion and teaching in U.S. Pat. No. 6,325,708. Left wall 120 and right wall 122 together form base 124 which has an outer sanding surface 126. One will note from the diagram that due to the fact that most interior corners in residential and commercial construction are more or less at 90 degrees, the smaller angle subtended by left wall 120 and right wall 122 creates a large gap 130 on one side and smaller gap 132 on the other side of sanding tool 103 as shown in FIG. 2. This gap results purely out of the fact that the angular relationship between left wall 120 and right wall 122 is less than 90 degrees and is also depicted in FIG. 4 of U.S. Pat. No. 6,325,708. In this manner the sanding tool 103 more aggressively sands in the wall board corner 108 and less aggressively sands away from the corner namely in the area of large gap 130 as shown in FIG. 2. This is what is described in the prior art and claimed to the be the inventive feature of the patented device in U.S. Pat. No. 6,325,708.

Referring now to FIG. 3 using the prior art depicted in FIG. 2 and described in U.S. Pat. No. 6,325,708 may result in a finished corner contour as schematically depicted in FIG. 3. FIGS. 3 and 4 show schematically in exaggerated fashion the corner geometry after sanding.

One side of the sanding tool 103 may create or cause paper thinning 144 as shown in FIG. 3 and due to the fact that the left wall 120 and right wall 122 do not impinge with equal pressure on either side of the wall, one would tend to get ridges 140 forming which run vertically up and down the wall near the corner and/or valleys 142 near the drywall compound corner 109 which again run vertically up and down along the wall parallel to the corner. These ridges 140, valleys 142 and paper thinning 144 is highly undesirable in that the contractor and the manufacturers of the finished walls preferably would like to have a very smooth and unnoticeable transition between the two adjacent wall boards and a very smooth corner joint.

The reader will also note that the gap or the distance between the wallboard corner 108 and the drywall compound corner 109 which is depicted is roughly the thickness of the paper 110 results in impingement of the sanding tool 103 onto the paper 110. Sanding of the paper is undesired in that it creates a very rough and non-uniform surface.

Preferably one would like to leave a uniformly even film of drywall compound in and around corner 108 which provides for a smooth transition from the corner to the outward portions of each of the wallboards.

FIG. 4 is a schematic cross sectional view of an inside wallboard corner showing the results of sanding with the presently described device namely corner sander base 200 and/or corner sander 201 and/or corner sander 203. The reader will note that two wallboards 104 abut each other in perpendicular arrangement thereby producing the 90 degree inside corner as is normally the case in residential or commercial construction. There usually is a small joint gap 106 created between the wallboards 104 where they intersect at wallboard corner 108 which is the corner in behind paper 110.

As previously discussed normally paper 110 is placed into wallboard corner 108 to cover up joint gap 106 and thereafter drywall compound 112 is applied. Once it has been applied and sanded one ends up with finished corner as shown in FIG. 4. In this case the corner configuration shown would be created using the presently described device namely corner sander base 200 and/or corner sander 201 or 203 described later on herein.

The reader will note that there is a substantial amount of drywall compound and/or thickness between wallboard corner 108 and drywall compound corner 113. The amount of drywall compound feathers uniformly away as one moves away from wallboard corner 108. In other words the thickness of the drywall compound is greatest at drywall compound corner 113 and becomes subsequently thinner and tapers away to nothing as one moves away from wallboard corner 108.

Ideally this will ensure that there is no damage of paper 110 or impingement of the abrasive and/or sandpaper onto paper 110 and that there is a uniform amount of drywall compound left in drywall compound corner 113 and a smooth transition away until one only sees outer wall surface 111 of each of wallboards 104.

Preferably there is a smooth transition area shown as 115 where the drywall compound ends and the outer wall surface 111 begins. This smooth transition will almost be invisible to the naked eye due to the very subtle feathering and transitioning from drywall compound corner 113 away from the corner.

Figure 5:
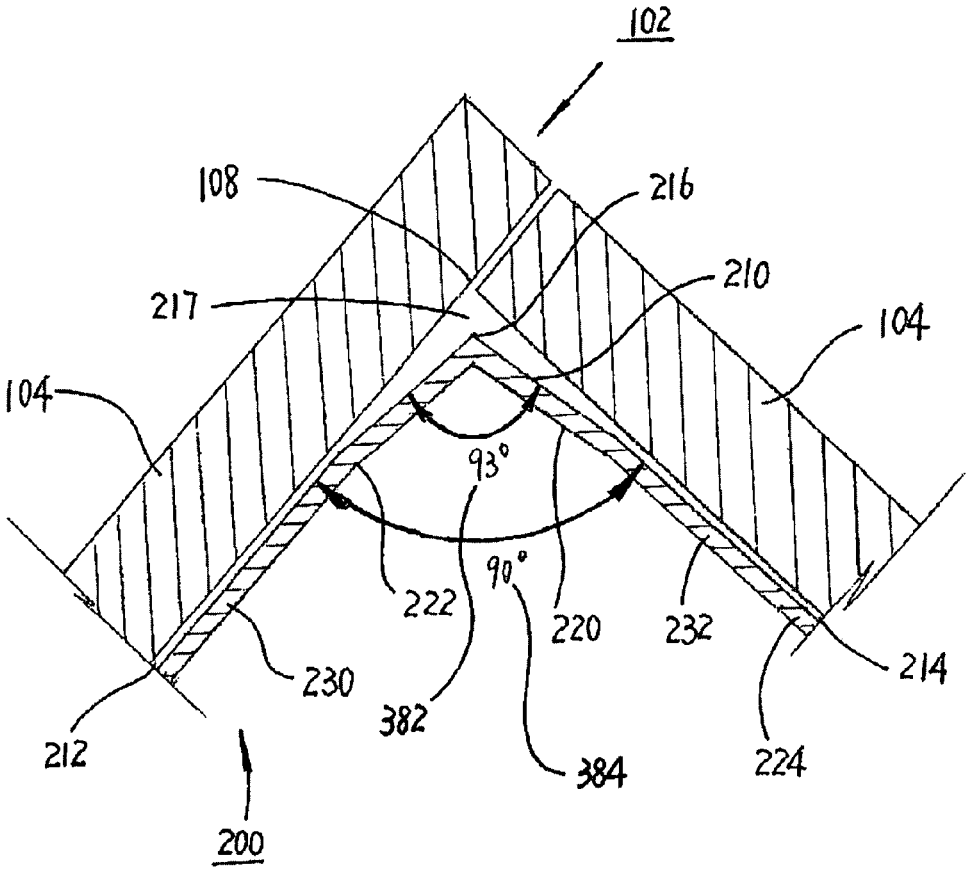
FIG. 5 is a schematic cross sectional view of an inside wallboard corner showing the presently described device, a corner sander positioned or deployed against the corner.

Now referring to FIG. 5 which is a schematic cross sectional view of an inside wallboard corner 102 together with the presently described device namely corner sander base 200 shown deployed against each of the wall boards.

Figure 6:
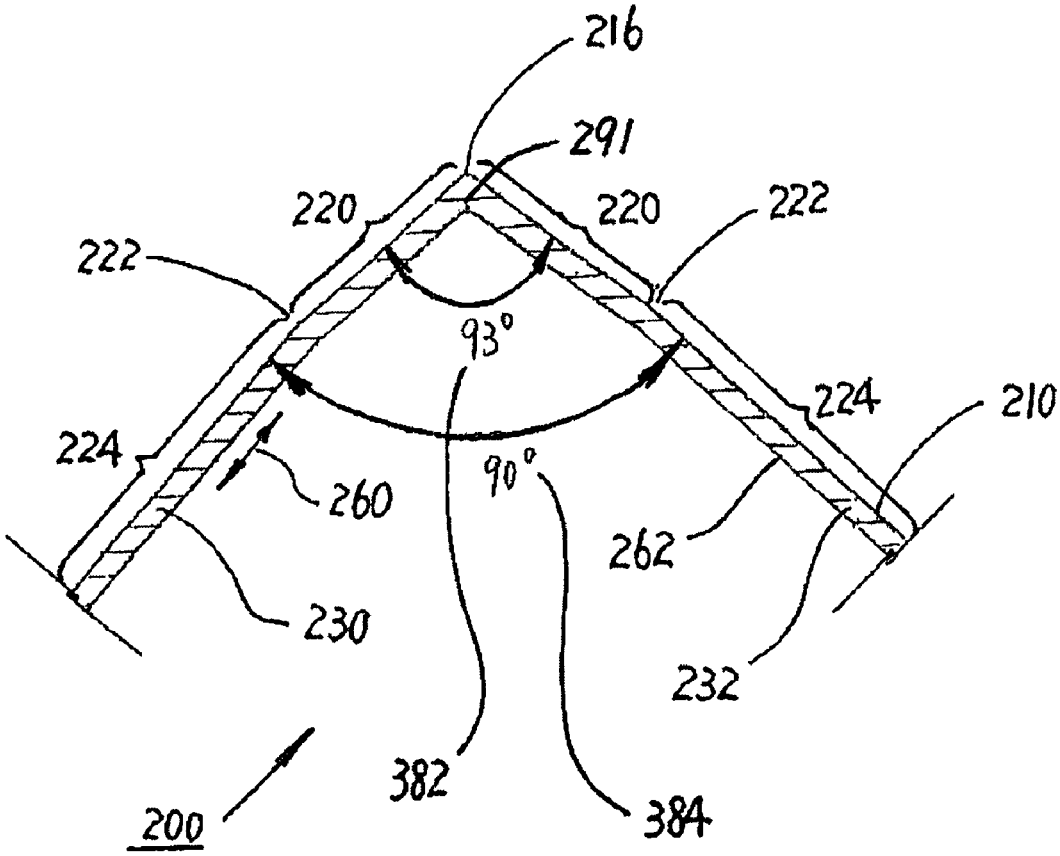
FIG. 6 is a cross sectional schematic view of the presently described device a corner sander base 200 showing the various geometries of the first and second opposed members which make up the base.

FIG. 5 shows two wallboards 104 abutting at approximately perpendicular angles to each other at wallboard corner 108 together with corner sander base 200 shown deployed against each of the wallboards 104. Referring now to FIG. 6 as well corner sander base 200 preferably includes a tip 216, a sanding surface 210, a forward section 220, a transition section 222 and a rear section 224. Corner sander base 200 is comprised of a first member 230 and a second member 232 which are joined at a juncture 291 where they form a tip 216.

FIG. 5 shows that there is a very small right gap 214 and left gap 212, both of these gaps being roughly the same amount. In practice however, there likely will be little or no gap on either the left side or the right side due to the fact that the rear section 224 of both of the first member 230 and the second member 232 subtend an angle of approximately 90 degrees which is equivalent to the angle of the corner as constructed.

The reader will note that there is a substantial tool gap 217 between tip 216 and wallboard corner 108 which is purposely introduced to allow for a predetermined amount of drywall compound 112 to be left behind thereby ensuring that paper 110 which is placed in the corner is not damaged due to the sanding process.

Referring now to FIG. 6 which shows corner sander base 200 in cross sectional view which preferably includes a tip 216, a first member 230 which is connected to a second member 232 at tip 216 or juncture 291 to form a V shaped corner base 200. Both first member 230 and second member 232 include a forward section 220 a transition area 222 and a rear section 224. The two members joined together form a V shaped corner sander base 200 which defines an outer sanding surface 210 and a base inner surface 262.

The reader will note that the two forward sections of both first member 230 and second member 232 subtends a forward angle 382 greater than 90 degrees and preferably between 91 and 95 degrees and more preferably at approximately 93 degrees. Beyond the transition moving away from tip 216, the rear sections 224 of each of first member 230 and second member 232 subtends a rear angle 384 of approximately 90 degrees as shown in FIG. 6. The relationship between forward angle 382 and rear angle 384 being such that a tool gap 217 is maintained. In other words the angular relationship is dimensioned to ensure that tip 216 does not contact wallboard corner 108 but rather has a standoff shown as tool gap 217. The transition portion is oriented along the longitudinal direction 292 and defines the portion of the first member and second member which joins together the forward and rear. It is preferably a smooth curved transition when viewed in cross section through the radial direction as shown in FIG. 7 but may also be a well defined longitudinally running edge as depicted in FIG. 5 or 6 for example.

The transition section would preferably be smoothed out so that it is barely noticeable to the eye and sanding will not leave a noticeable line or ridge on the wall in the vertical longitudinal direction parallel to the corner.

Figure 7:
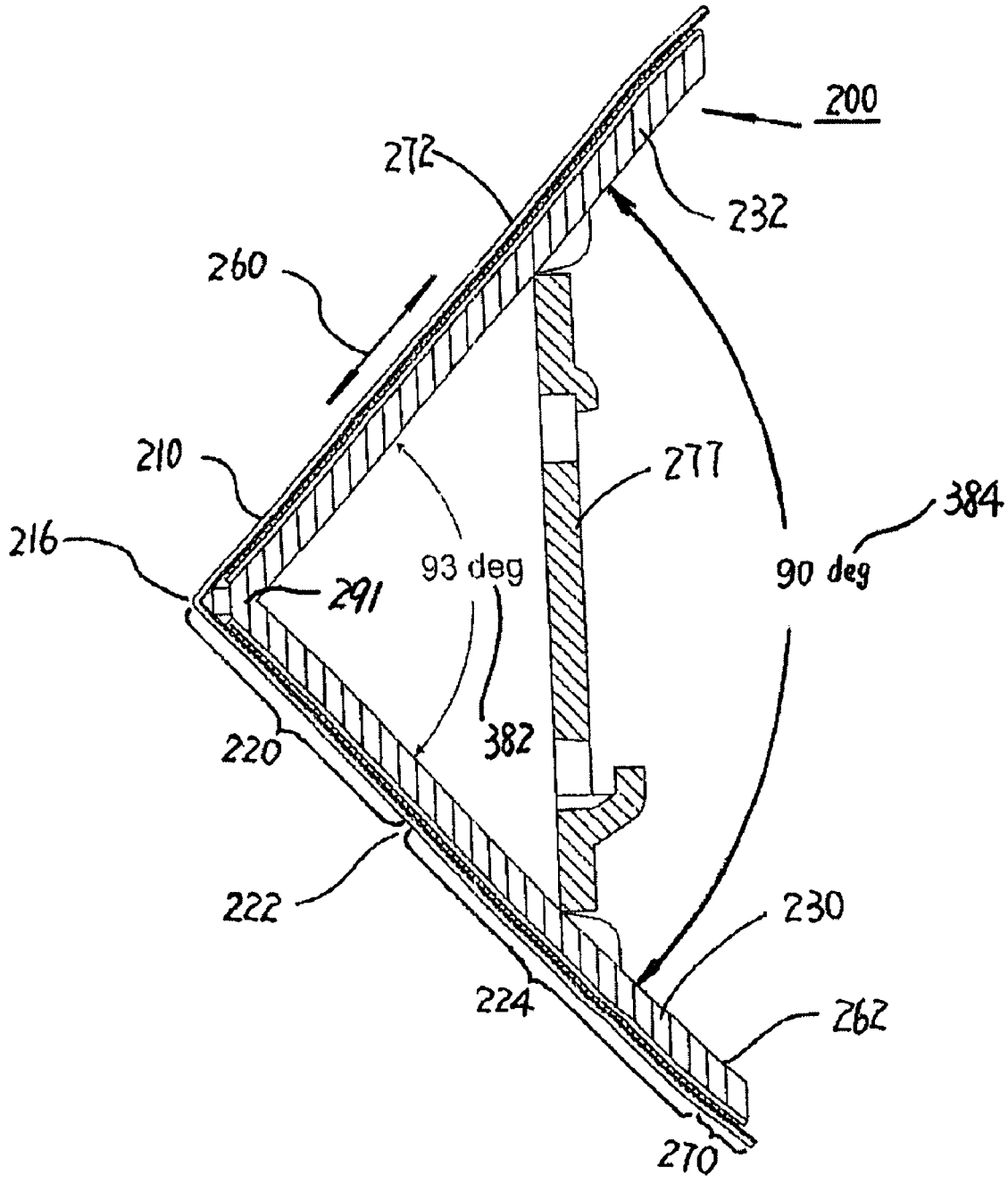
FIG. 7 is a schematic cross sectional view of the presently described device a corner sander base 200 showing the base together with abrasive material attached thereto and the first and second opposed members and their geometries.

Referring now to FIG. 7 which shows in cross section corner sander base 200 together with a frame portion 277. First member 230 and second member 232 defines a sanding surface 210 which can be covered with abrasive material 272. The abrasive material can be attached to corner sander base 200 using gluing and/or any other conventional means including hook and loop type fasteners.

Furthermore, preferably the distal ends furthest away from tip 216 of first member 230 and second members 232 include a small rear flair 270 such that the members taper away from the wallboard when it is positioned into a corner. This provides for a smooth transition of the corner sander base 200 away from the wall and ensures that there are no vertical streaks and/or ridges which form as a result of sanding.

Figure 8:
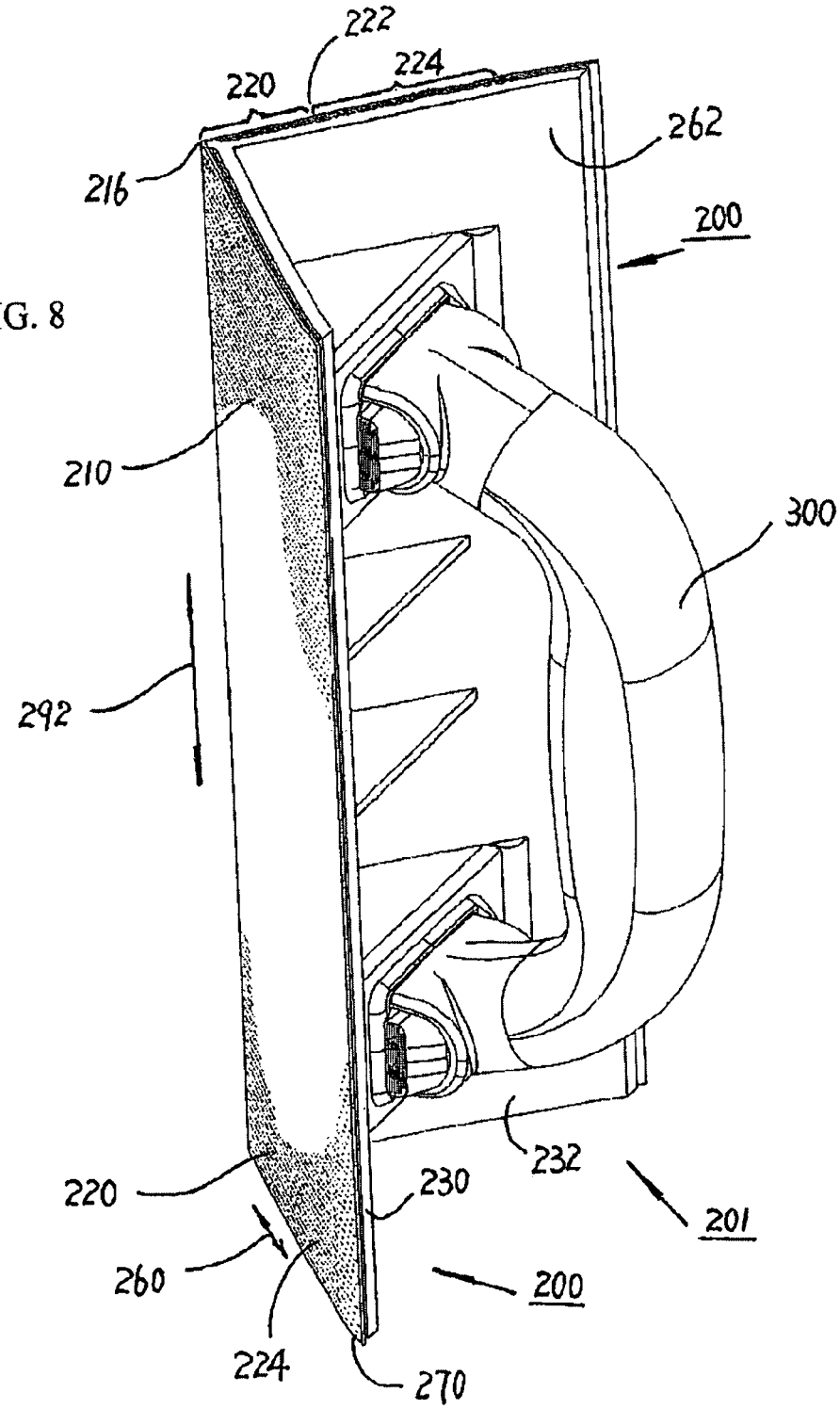
FIG. 8 is an upright perspective schematic view of the entire corner sander 201 showing the corner sander base 200 connected to a handle.
Figure 9:
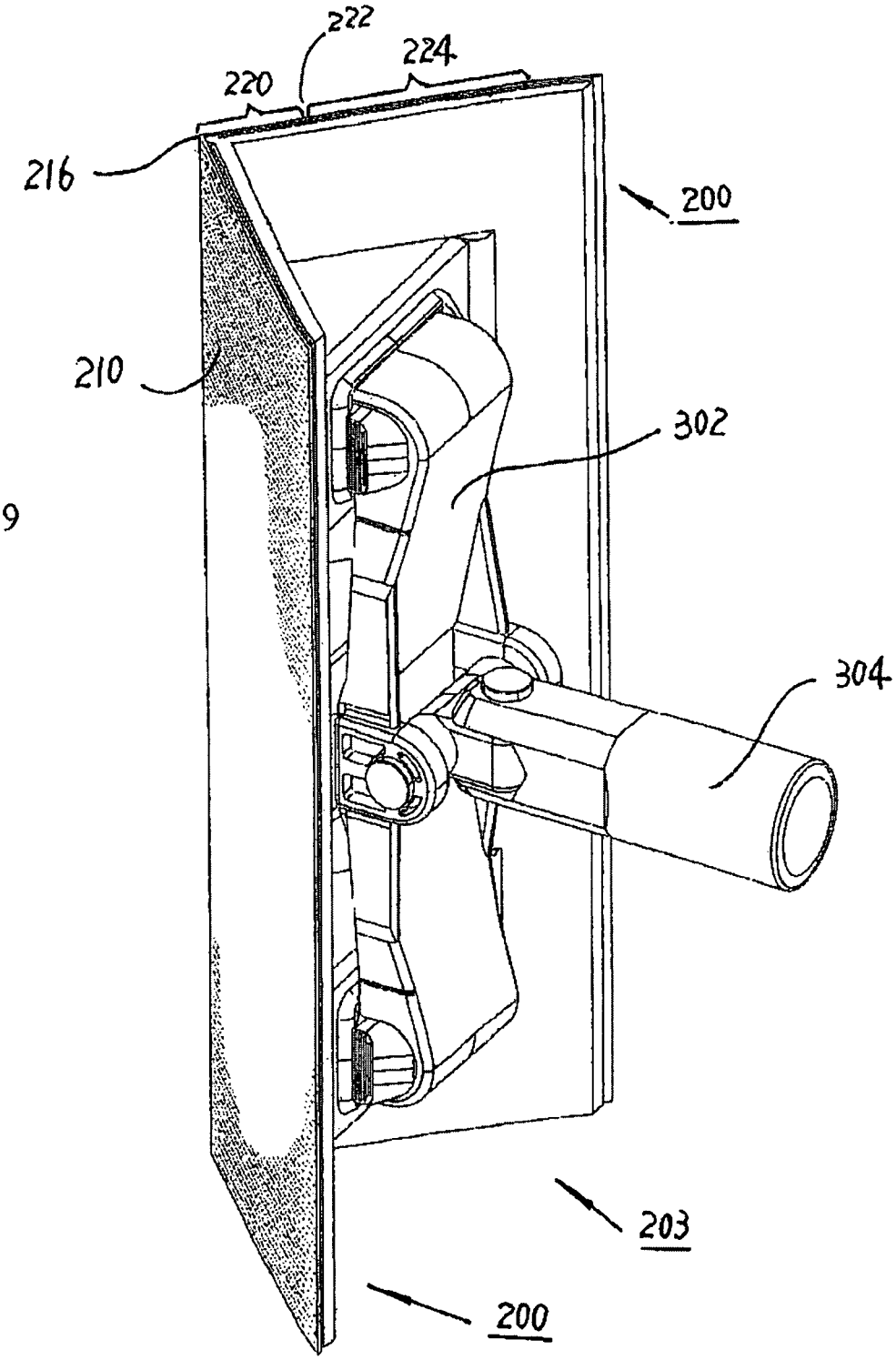
FIG. 9 is an upright schematic perspective view of corner sander 203 wherein the corner sander base 200 is shown connected to a fine and pole attachment.

FIGS. 8 and 9 show the corner sander base connected to a handle 300 as shown in FIG. 8 and/or a frame 302 and a pole attachment 304 as shown in FIG. 9. The handle 300 and pole attachment 304 are well known devices in the art of corner sanders.

The diagrams define the longitudinal direction 292 which is normally a direction which the corner sander 201 is urged in, in order to effect sanding, namely up and down vertically along the corner of the inside wall board corner.

Radial direction 260 is shown in FIG. 8. First member 230 and second member 232 are shown in cross section in the radial plane in FIG. 6 and FIG. 7. Sanding surface 210 is the outer surface defined by the first and second members 230 and 232 as shown in FIG. 8. Sanding surface 210 includes portion of the outer surfaces defined by forward section 220, transition section 222 and rear section 224 as shown.

As shown in FIG. 9 alternatively the corner sander base 200 could be attached to a frame 302 which in turn is attached to a pole attachment 304 for use as a pole sander into the corner.

It should be apparent to persons skilled in the arts that various modifications and adaptation of this structure described above are possible without departure from the spirit of the invention the scope of which defined in the appended claim.

I claim:

1. A corner sander base including a sanding surface, the corner sander base for sanding proximate interior wallboard corners, the corner sander base comprising;

a. a first member and a second member connected together at a longitudinally oriented juncture where they form a tip, one side of the members defines a sanding surface;

b. each member includes a planar forward section which in the radial direction originates at the juncture and terminates at a longitudinally oriented transition wherein a forward angle is the angle subtended between the planar forward sections in the radial plane, c. each member further includes a planar rear section originating at the transition and connected to the forward section at the transition wherein a rear angle is the angle subtended between the planar rear sections in the radial plane, d. wherein the forward and rear angles selected to more aggressively sand the areas at the rear sections and less aggressively sand the area at the tip and forward section.

2. The corner sander base claimed in claim 1 wherein the forward angle being greater than 90 degrees.

3. The corner sander base claimed in claim 1 wherein the forward angle subtends an angle of 93 degrees.

4. The corner sander base claimed in claim 1 wherein the rear angle subtends an angle which is less than the forward angle.

5. The corner sander base claimed in claim 1 wherein the rear angle subtends an angle which is less than the forward angle and the rear angle is also less than or equal to 90 degrees.

6. The corner sander base claimed in claim 1 wherein the forward angle subtends an angle of substantially 93 degrees and the rear angle subtends an angle of substantially 90 degrees.

7. The corner sander base claimed in claim 1 wherein the transition defines the portion of the first member and second member which joins together the forward and rear sections and is a smooth curved shaped transition when viewed in cross section in the radial plane.

8. The corner base sander claimed in claim 1 wherein the sanding surface adapted to receive abrasive material thereon.

9. The corner base sander claimed in claim 1 further including a frame portion spanning between the first and second members and attached to a base inner surface for supporting and stiffening the first and second members.

10. The corner base sander claimed in claim 1 further including a means for holding or manipulating the corner base sander.

11. The corner base sander claimed in claim 7 wherein the holding means selected from the group consisting of a handle, and a pole attachment.

12. A corner sander base for sanding drywall compound smooth proximate internal wallboard corners the corner sander base comprising;

a) a first member and second member are joined together at a juncture oriented along a longitudinal direction thereby forming a V shaped corner sander such that the joined together first second members defining an outer sanding surface;

b) wherein the first member and second members each includes a planar forward section which meets at the juncture and subtends a forward angle relative to each other;

c) wherein the first member and second members also each includes a planar rear section joined to the forward section at a longitudinally oriented transition and wherein the rear sections subtend a rear angle relative each other;

d) wherein the angular relationship between the forward angle and the rear angle selected such that a tool gap is maintained between the juncture and the wall board corner.

13. The corner sander base claimed in claim 12 wherein the forward angle being greater than 90 degrees.

14. The corner sander base claimed in claim 12 wherein the forward angle subtends an angle between 91 and 95 degrees.

15. The corner sander base claimed in claim 12 wherein the forward angle subtends an angle of 93 degrees.

16. The corner sander base claimed in claim 12 wherein the rear angle subtends an angle which is less than the forward angle.

17. The corner sander base claimed in claim 12 wherein the rear angle subtends an angle which is less than the forward angle and the rear angle is also less than or equal to 90 degrees.

18. The corner sander base claimed in claim 12 wherein the forward angle subtends an angle of substantially 93 degrees and the rear angle subtends an angle of substantially 90 degrees.

19. The corner sander base claimed in claim 12 wherein the transition defines the portion of the first member and second member which joins together the forward and rear sections and is a smooth curved shaped transition when viewed in cross section through the radial direction.

20. The corner sander base claimed in claim 12 wherein the transition defines the portion of the first member and second member which joins together the forward and rear sections and is a longitudinally running edge shaped transition when viewed in cross section through the radial direction.

* * * * *